US010950955B2

(12) United States Patent
Martin

(10) Patent No.: US 10,950,955 B2
(45) Date of Patent: Mar. 16, 2021

(54) INSULATION PIERCING CONNECTOR

(71) Applicant: Hubbell Incorporated, Shelton, CT (US)

(72) Inventor: Evan Martin, Merrimack, NH (US)

(73) Assignee: Hubbell Incorporated, Shelton, CT (US)

( * ) Notice: Subject to any disclaimer, the term of this patent is extended or adjusted under 35 U.S.C. 154(b) by 128 days.

(21) Appl. No.: 16/184,933

(22) Filed: Nov. 8, 2018

(65) Prior Publication Data

US 2019/0140368 A1 May 9, 2019

Related U.S. Application Data

(60) Provisional application No. 62/583,285, filed on Nov. 8, 2017.

(51) Int. Cl.

| | |
|---|---|
| ***H01R 4/24*** | (2018.01) |
| ***H01R 4/46*** | (2006.01) |
| ***H01R 11/20*** | (2006.01) |
| ***H01R 4/26*** | (2006.01) |
| ***H01R 11/03*** | (2006.01) |
| ***H01R 4/38*** | (2006.01) |
| ***H01R 4/2408*** | (2018.01) |
| *H01R 9/03* | (2006.01) |

(52) U.S. Cl.
CPC ..... *H01R 4/2408* (2013.01); *H01R 9/03* (2013.01)

(58) Field of Classification Search
CPC ..... H01R 11/20; H01R 13/523; H01R 4/62; H01R 4/46
USPC ..... 439/781, 785, 804, 812, 402, 404, 413, 439/423, 425–426
See application file for complete search history.

(56) References Cited

U.S. PATENT DOCUMENTS

| | | | | |
|---|---|---|---|---|
| 3,848,956 | A * | 2/1974 | Kraft | 339/98 |
| 3,901,577 | A * | 8/1975 | Philibert | 339/98 |
| 4,427,253 | A * | 1/1984 | Smith | 339/98 |
| 5,004,437 | A * | 4/1991 | Walter | 339/98 |
| 5,041,012 | A | 8/1991 | Caprio | |
| 5,157,814 | A * | 10/1992 | Mann | 339/98 |
| 5,888,104 | A * | 3/1999 | Mello | H01R 13/24 |
| 5,934,818 | A * | 8/1999 | Schmitt | H01R 13/46 439/804 |
| 6,011,218 | A * | 1/2000 | Burek | H01R 13/38 |
| 6,581,791 | B2 * | 6/2003 | Flint | 339/98 |
| 6,591,055 | B1 * | 7/2003 | Eslambolchi | H01R 13/20 439/426 |
| 7,803,001 | B2 * | 9/2010 | Wason | H01R 4/38 439/100 |
| 7,922,516 | B2 * | 4/2011 | Temblador | H01R 9/031 439/431 |

(Continued)

*Primary Examiner* — Abdullah A Riyami
*Assistant Examiner* — Thang H Nguyen
(74) *Attorney, Agent, or Firm* — Michael Best & Friedrich LLP

(57) ABSTRACT

A connector includes a clamping member, a base, and a body. A first channel is formed between the clamping member and the body, and at least one second channel is formed between the base and the body. The positions of the base and the body relative to one another and relative to the clamping member are adjustable to modify the size of the first channel and the second channel. Insulation-piercing members electrically connect a conductor in the first channel to one or more conductors in the second channel(s).

20 Claims, 6 Drawing Sheets

(56) References Cited

U.S. PATENT DOCUMENTS

| | | | | |
|---|---|---|---|---|
| 8,556,937 | B2 * | 10/2013 | Ludwig | A61B 17/7071 606/250 |
| 9,287,673 | B2 * | 3/2016 | Galla | H01R 9/031 |
| 9,557,509 | B2 * | 1/2017 | Skolozdra | G02B 6/4471 |
| 9,787,004 | B2 * | 10/2017 | Dinh | H01R 4/40 |
| 9,812,829 | B1 * | 11/2017 | Weiden | H01R 4/363 |
| 10,185,106 | B2 * | 1/2019 | Skolozdra | G02B 6/4471 |
| 2001/0024909 | A1 * | 9/2001 | Wakata | H01R 13/24 439/785 |
| 2013/0252486 | A1 * | 9/2013 | Kosyanchuk | H01R 4/304 439/813 |
| 2015/0333457 | A1 * | 11/2015 | Liu | H01H 13/14 335/208 |

* cited by examiner

INSULATION PIERCING CONNECTOR

REFERENCE TO RELATED APPLICATION

This application claims the benefit of prior-filed U.S. Provisional Patent Application No. 62/583,285, filed Nov. 8, 2017, the entire contents of which are incorporated by reference herein.

FIELD

The present disclosure relates generally to connectors for utility cabling, and particularly to tap connectors for electrically connecting at least two conductors.

SUMMARY

In some aspects, a connector includes a clamping member, a base, and a body. A first channel is formed between the clamping member and the body, and at least one second channel is formed between the base and the body. The positions of the base and the body relative to one another and relative to the clamping member are adjustable to modify the size of the first channel and the second channel. Insulation-piercing members electrically connect a conductor in the first channel to one or more conductors in the second channel(s).

In one independent aspect, a connector for electrically connecting a first conductor and a plurality of second conductors includes: a clamping member including a pair of shafts and an intermediate portion extending between the shafts; a base coupled between the shafts and spaced apart from the intermediate portion, the base including a plurality of first grooves; a body coupled between the shafts and positioned between the base and the intermediate portion, a first channel formed between the intermediate portion and the body, the body including a plurality of second grooves, one of the second grooves cooperating with an associated one of the first grooves to form a second channel, the body forming an electrically conductive path between the first conductor positioned in the first channel and a second conductor positioned in the second channel; a first insulation-piercing member positioned in the first channel for engaging the first conductor; and a plurality of second insulation-piercing members, each second insulation-piercing member positioned in an associated one of the second channels.

In another independent aspect, a connector for electrically connecting a first conductor and a plurality of second conductors includes: a clamping member including a pair of shafts and a bridge positioned proximate one end of the shafts, the bridge including a first end coupled to one of the shafts and a second end coupled to the other of the shafts; a base coupled between the shafts and positioned proximate an opposite end of the shafts, the base including a plurality of first grooves; a body coupled between the shafts and positioned between the base and the bridge, a first channel formed between the bridge and the body, the body including a plurality of second grooves, one of the second grooves cooperating with an associated one of the first grooves to form a second channel, the body forming an electrically conductive path between the first conductor positioned in the first channel and a second conductor positioned in the second channel; a first insulation-piercing member positioned in the first channel for engaging the first conductor; and a plurality of second insulation-piercing members, each second insulation-piercing member positioned in an associated one of the second channels.

In yet another independent aspect, a connector for electrically connecting a first conductor and a plurality of second conductors includes: a U-shaped member including a pair of substantially parallel legs and an intermediate portion connecting the legs; a base coupled between the legs and positioned proximate ends of the legs, the base including a plurality of first grooves; a body coupled between the legs and positioned between the base and the intermediate portion, a first channel formed between the intermediate portion and the body, the body including a plurality of second grooves, one of the second grooves cooperating with an associated one of the first grooves to form a second channel, the body forming an electrically conductive path between the first conductor positioned in the first channel and a second conductor positioned in the second channel; a first insulation-piercing member positioned in the first channel for engaging the first conductor; and a plurality of second insulation-piercing members, each second insulation-piercing member positioned in an associated one of the second channels.

Other aspects of the invention will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 5:
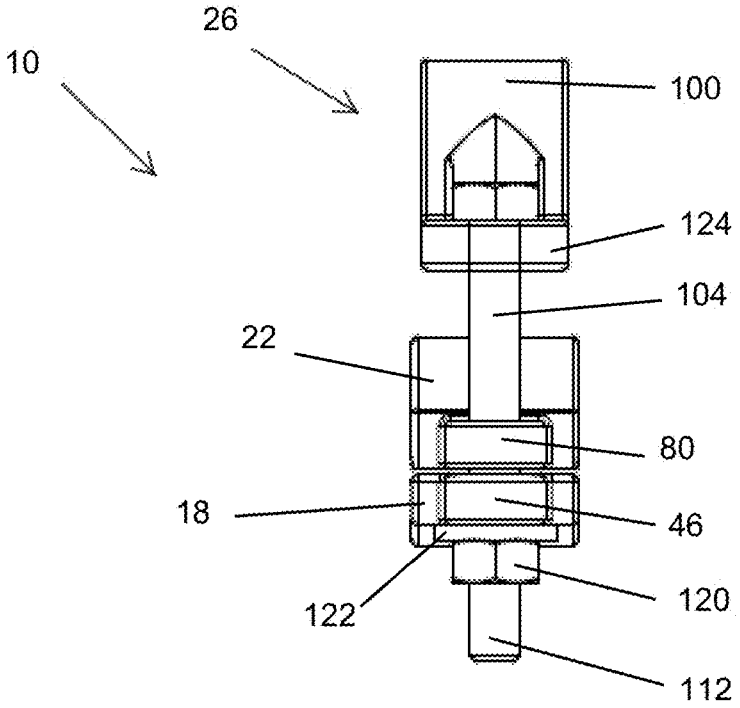
FIG. 5 is a side view of the connector of FIG. 4.
Figure 6:
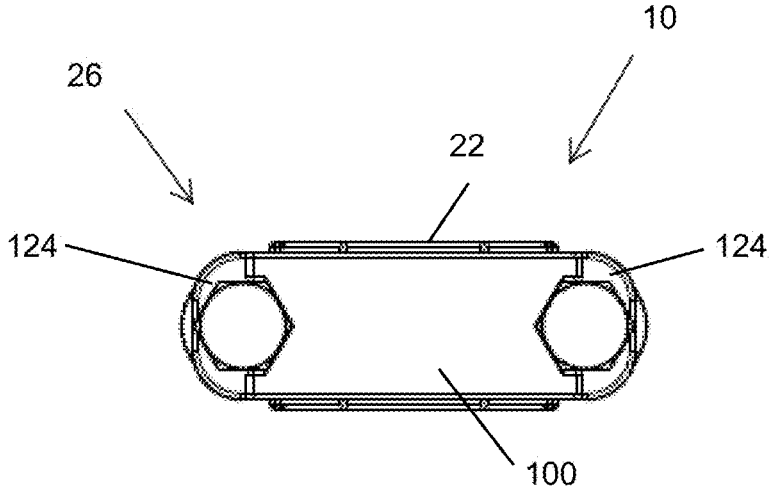
FIG. 6 is an end view of the connector of FIG. 4.
Figure 7:
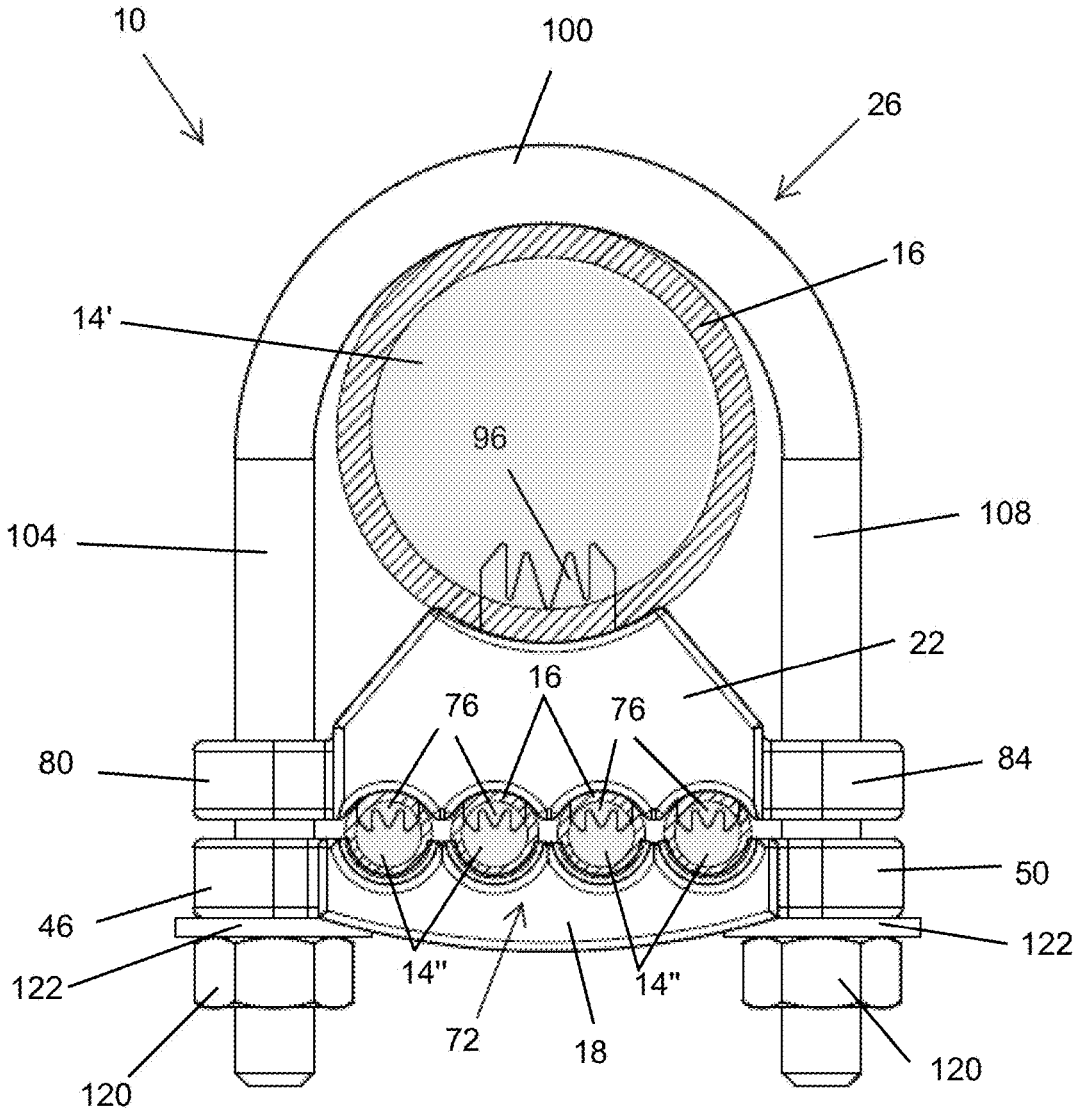
FIG. 7 is an elevation view of the connector of FIG. 1 including conductors.
Figure 8:
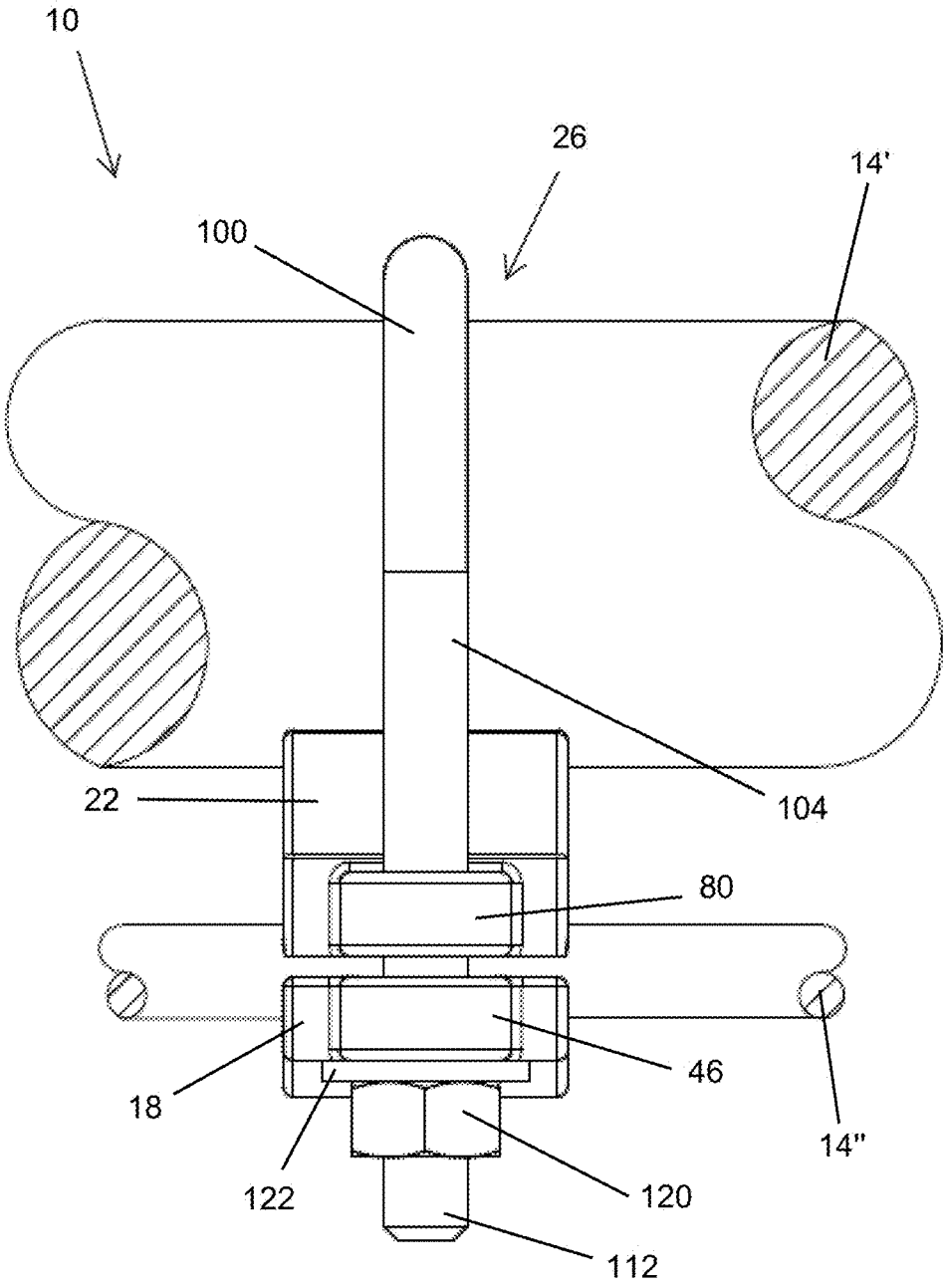
FIG. 8 is a side view of the connector and conductors of FIG. 7.

FIGS. 1-8 illustrate a connector 10 for coupling two or more conductors 14', 14" (FIGS. 7 and 8). The connector 10 includes insulation piercing members or teeth 76, 96 for penetrating the insulation layer 16 and engaging the conducting portions 14', 14" in electrical contact. In the illustrated embodiment, the connector 10 includes a base 18, a body 22, and a clamping member 26.

Figure 1:
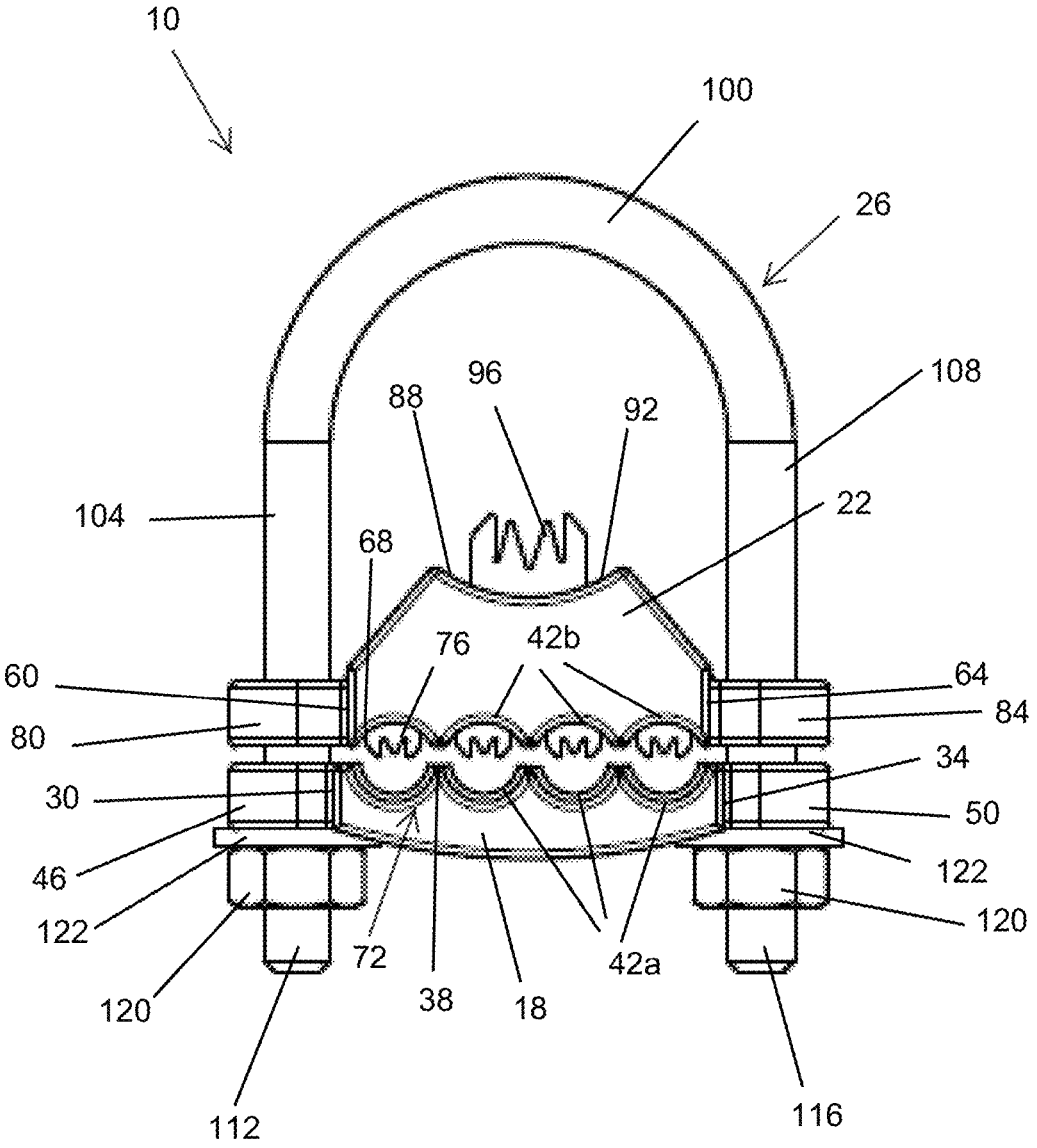
FIG. 1 is an elevation view of a connector.
Figure 2:
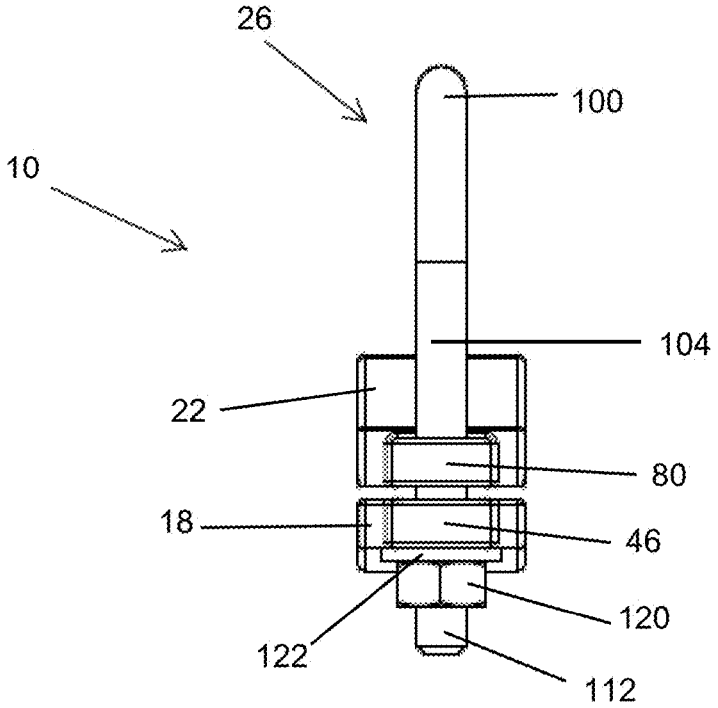
FIG. 2 is a side view of the connector of FIG. 1.
Figure 3:
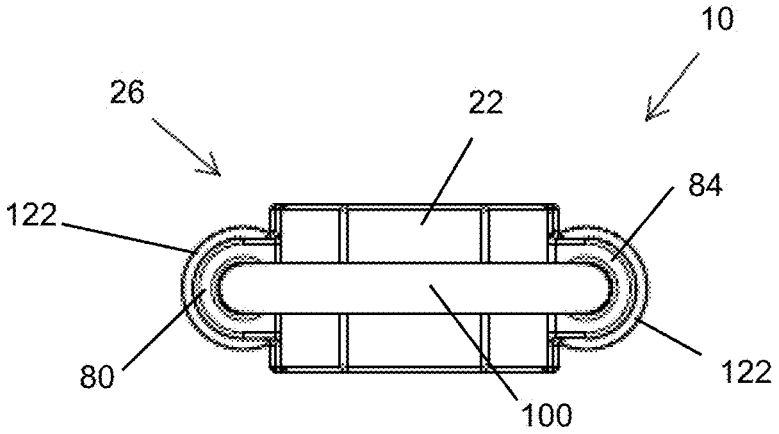
FIG. 3 is an end view of the connector of FIG. 1.

As shown in FIG. 1, the base 18 includes a first end 30 and a second end 34 opposite the first end 30. A side 38 extends between the first end 30 and the second end 34. The side 38 includes semi-circular grooves 42*a* in facing relationship with the body 22. In some embodiments, the base 18 may be formed from a non-conductive material such as plastic, rubber, etc. In the illustrated embodiment, the base 18 is formed from plastic. First and second end projections 46, 50 are positioned adjacent each of the first and second ends 30, 34, respectively. The first and second end projections 46, 50 include apertures (not shown) through which shafts 108 of the clamping member 26 extend.

The body 22 includes a first end 60 and a second end 64 opposite the first end 60. A first side 68 extends between the first end 60 and the second end 64 and is in facing relationship with the side 38 of the base 18. In addition, the first side 68 includes semi-circular grooves 42*b* corresponding to the semi-circular grooves 42*a* positioned on the side 38 of the base 18 such that grooves 42*a*, 42*b* on the base 18 and the body 22, respectively, cooperate to form channels 72. The channels 72 are configured to receive at least one of the conductors 14". Teeth 76 are positioned within the channels 72 for piercing insulation layers 16 (FIG. 7) of the conductors 14". In the illustrated embodiment, the teeth 76 are coupled to the first side 68 of the body 22 within each channel 72. In other embodiments, the teeth 76 may be supported in another manner (e.g., supported in the grooves 42*a* on the base 18) and/or may be positioned in less than all of the grooves 42*b*. In the illustrated embodiment, the teeth 76 are each formed as a single base having at least three fingers or protrusions; in other embodiments, the teeth may be formed as one or more individual protrusions.

The body 22 further includes first and second end projections 80, 84 corresponding to the first and second end projections 46, 50 of the base 18. Similarly, the first and second end projections 80, 84 include apertures (not shown) aligned with the apertures of the first and second end projections 46, 50 of the base 18. The end projections 80, 84 of the body 22 may be formed from a non-conductive material such as plastic, rubber, etc. In the illustrated embodiment, the end projections 80, 84 of the body 22 are formed from rubber.

Figure 4:
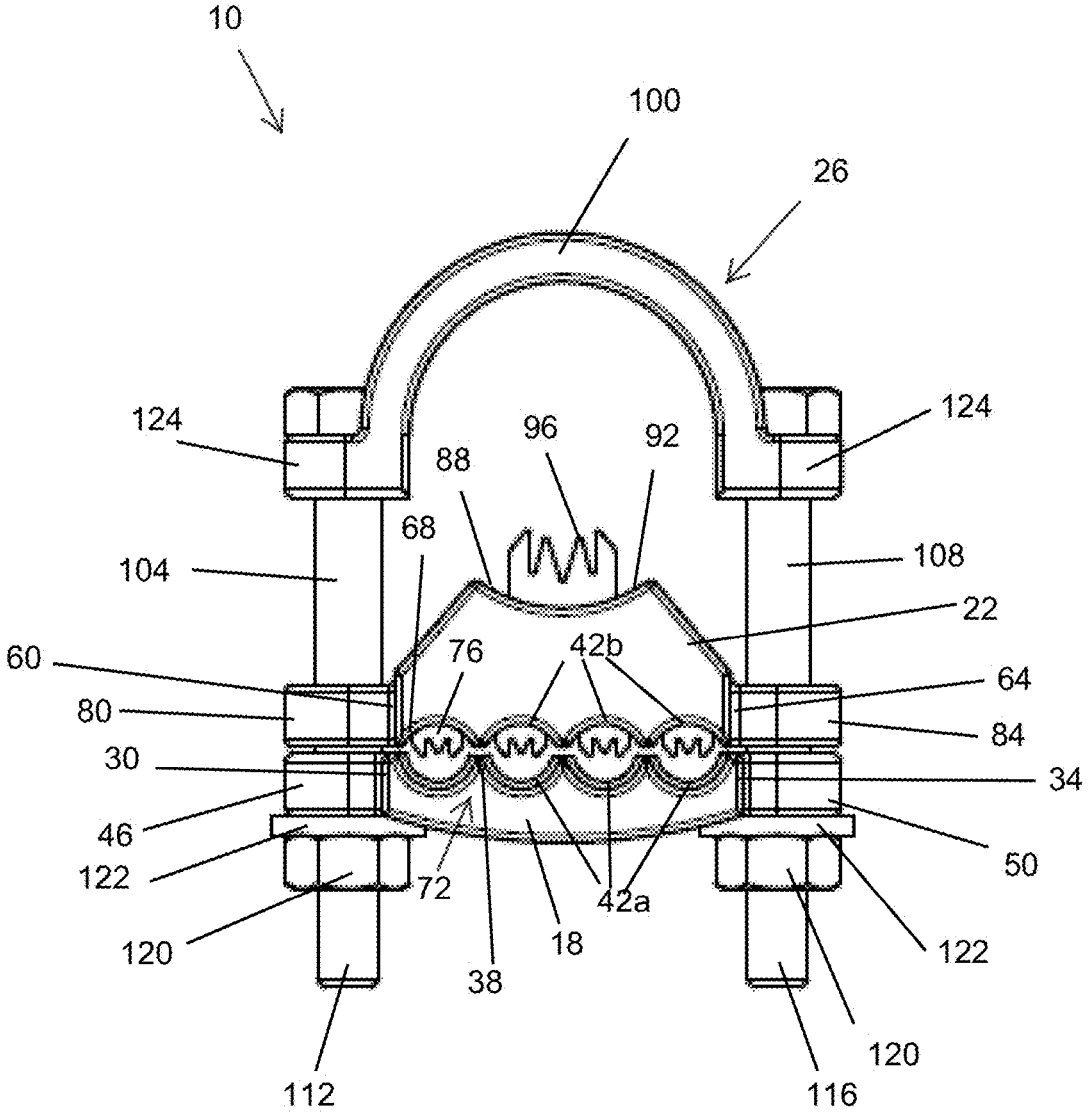
FIG. 4 is an elevation view of a connector according to another embodiment.

As shown in FIGS. 1 and 4, the body 22 includes a second side 88 opposite the first side 68. The second side 88 is in facing relationship with an intermediate portion of the clamping member 26 and at least a portion of an arcuate groove 92 is formed on the second side 88. Teeth 96 are coupled to the second side 68 and positioned within the groove 92. In other embodiments, the teeth 96 may be supported in another manner. The teeth 96 are positioned within the groove 92 for piercing the insulation layer 16 of a conductor 14' (FIG. 7). In the illustrated embodiment, the teeth 96 are formed as a single base having multiple fingers or protrusions. In other embodiments, the teeth 96 may be formed as one or more individual protrusions positioned within the groove 92.

The teeth 76, 96 are formed from an electrically conductive material and are connected to one another by the body 22. In some embodiments, the body 22 includes an electrically conductive member (not shown) providing an electrically conductive path through the body 22. Furthermore, the electrically conductive path electrically connects at least two of the conductors 14', 14" when the teeth 76, 96 pierce the insulation layers 16 of the conductors 14', 14". In the illustrated embodiment, the teeth 76, 96 are formed from tin-plated copper. The insulation of the conductors 14', 14" and the non-conductive materials of the base 18 and the body 22 inhibit the formation of an electrical connection to other portions of the connector 10 (i.e., the clamping member 26) other than the teeth 76, 96 and the conductors 14', 14".

Referring again to FIG. 1, the clamping member 26 includes an intermediate portion or main portion 100 and two shafts or leg portions 104, 108 coupled to the main portion 100. The clamping member 26 is configured to clamp at least one of the conductors 14' between the main portion 100 of the clamping member 26 and the groove 92 positioned on the second side 68 of the body 22. The two leg portions 104, 108 extend from the main portion 100 and through the first and second end projections 46, 50 of the base 18 and through the first and second end projections 80, 84 of the body 22, respectively. In addition, the two leg portions 104, 108 include ends 112, 116 having threaded portions. A fastening element 120 (e.g., a hex nut) is positioned on the threads of each leg portion 104, 108 to retain the base 18 relative to the clamping member 26. A load-bearing member 122 such as a washer may be positioned between the fastening element 120 and the first and second end projections 46, 50 of the base 18.

In the illustrated embodiment, the clamping member 26 is a U-shaped bolt or U-bolt. The clamping member 26 can be formed from a metallic material, such as stainless steel or galvanized steel.

As shown in FIGS. 1-2 and 4-5, the body 22 is adjustable relative to the base 18 for adjusting the connector 10 to different diameter sizes of the conductors 14', 14". Specifically, a position of the body 22 relative to the base 18 is adjustable by moving (i.e., sliding the body 22 upwardly or downwardly on the two leg portions 104, 108. For example, sliding the body 22 away from the base 18 (e.g., upwardly in FIG. 1) increases a dimension of the channels 72 to permit a larger conductor 14" to be positioned in the second channel 72. In addition, the fastening elements 120 bias the base 18 against the body 22, holding or clamping the conductors 14" within their respective channels 72 between the base 18 and the body 22.

The body 22 is further adjustable relative to the clamping member 26 by moving (i.e., sliding) the body 22 upwardly or downwardly along the leg portions 104, 108. Specifically, the body 22 may be adjusted to change a distance between the main portion 100 and the groove 92 of the body 22. For example, sliding the body 22 on the leg portions 104, 108 downwardly away from the main portion 100 increases a dimension between the main portion 100 and the groove 92. A main conductor 14' (FIG. 1) can be positioned and clamped between the main portion 100 and the groove 92. As such, the connector 10 is adjustable to receive different sizes of the conductors 14', 14" by changing the relative positions of the base 18, the body 22, and the clamping member 26.

As shown in FIGS. 1-3 and 7-8, the two leg portions 104, 108 are integral with the main portion 100 of the clamping member 26. In other words, the connector 10 includes a U-bolt as the clamping member 26. In one embodiment, the connector 10 is assembled between conductors 14', 14" by first positioning the clamping member 26 around a portion of a main conductor 14' (FIG. 7). The body 22 is then inserted onto the ends of the leg portions 104, 108, and the second conductors 14" are positioned in the respective grooves 42*b*. The base 18 is then inserted onto the ends of the leg portions 104, 108, and fasteners 120 are tightened to draw the body 22 and the base 18 toward the intermediate portion 100 of the clamping member 26.

FIGS. 4-6 illustrate a connector 10 according to another embodiment. As shown in FIGS. 4-6, the main portion 100 is formed as a separate component that is coupled between two straight shafts 104, 108. The main portion 100 includes two projections 124 positioned on ends of the main portion 100, and an arcuate portion extends between the projections 124. The two shafts 104, 108 are formed as substantially straight or linear bolts extending through the projections 124. Each of the bolts also extends through the first and second end projections 46, 50, of the base 18 and the first and second end projections 80, 84 of the body 22, respectively.

The clamping member 26 may provide additional rigidity to the connector 10. In the illustrated embodiment, the linear bolts may be formed from stainless steel, galvanized steel, etc.

As shown in FIGS. 7 and 8, in operation, a first conductor 14' is positioned between the clamping member 26 and the body 22. Furthermore, the first conductor 14' is clamped between the clamping member 26 and the body 22 and the teeth 96 pierce the insulation layer 16 of the first conductor 14' (FIG. 7). Second conductors 14" are positioned within a respective one of the channels 72 formed between the base 18 and the body 22. The second conductors 14" extend generally parallel to the first conductor 14' and are clamped between each of the grooves 42*a* of the base 18 and the corresponding grooves 42*b* of the body 22. The teeth 76 of each groove 42*b* pierce the insulation layers 16 of the respective one of the second conductors 14" (FIG. 8), and the conductors 14' and 14" are electrically connected to one another through the body 22. The connector 10 may couple one or more conductors 14" positioned within the channels 72 for electrically connecting the first conductor 14' with multiple second conductors 14". In the illustrated embodiment, the first conductor 14' has a relatively larger diameter than the diameters of the second conductors 14". The first conductor 14' may be a main conductor and the second conductors 14" may be tap conductors, and the main conductor may provide electrical current to each of the tap conductors.

The connector 10 is operable to adjust to conductors 14', 14" having different sizes. For example, the first conductor 14' has a larger diameter than the diameters of the second conductors 14". The position of the clamping member 26 relative to the body 22 is adjusted to accommodate the diameter of the first conductor 14'. In addition, the position of the body 22 relative to the base 18 is adjusted to accommodate the diameters of the second conductors 14". As such, the connector 10 is configured to adjust to and electrically connect conductors 14', 14" having different size diameters.

The embodiments described above and illustrated in the figures are presented by way of example only and are not intended as a limitation upon the concepts and principles presented herein. As such, it will be appreciated that variations and modifications exist within the scope and spirit of one or more independent aspects as described.

What is claimed is:

1. A connector for electrically connecting a first conductor and a plurality of second conductors, the connector comprising:

a clamping member including a pair of shafts and an intermediate portion extending between the shafts;

a base coupled between the shafts and spaced apart from the intermediate portion, the base including a plurality of first grooves;

a body coupled between the shafts and positioned between the base and the intermediate portion, a first channel formed between the intermediate portion and the body, the body including a plurality of second grooves, one of the second grooves cooperating with an associated one of the first grooves to form a second channel, the body forming an electrically conductive path between the first conductor positioned in the first channel and a second conductor positioned in the second channel;

a first insulation-piercing member positioned in the first channel for engaging the first conductor; and a plurality of second insulation-piercing members, each second insulation-piercing member positioned in an associated one of the second channels.

2. The connector of claim 1, wherein the body is movable relative to both the intermediate portion and the base to modify a size of the first channel and a size of the second channel.

3. The connector of claim 1, wherein the clamping member is a U-shaped bolt, each of the shafts having a threaded end, the intermediate portion formed integrally with the shafts and extending therebetween.

4. The connector of claim 1, wherein each of the shafts is a threaded bolt, the intermediate portion is a bridge coupled to a head of each threaded bolt.

5. The connector of claim 1, wherein the first insulation-piercing member includes a tooth protruding from a first end of the body proximate the first channel, and wherein each of the second insulation-piercing members includes a tooth protruding from a second side of the body opposite the first side.

6. The connector of claim 1, wherein the ends of the body include electrically-insulating members coupled to the shafts.

7. The connector of claim 1, wherein the base is formed of an electrically-insulating material.

8. The connector of claim 1, wherein the shafts include threaded ends, wherein the base is positioned adjacent the ends of the shafts and secured by members threadably engaging the threaded ends.

9. A connector for electrically connecting a first conductor and a plurality of second conductors, the connector comprising:

a clamping member including a pair of shafts and a bridge positioned proximate one end of the shafts, the bridge including a first end coupled to one of the shafts and a second end coupled to the other of the shafts;

a base coupled between the shafts and positioned proximate an opposite end of the shafts, the base including a plurality of first grooves;

a body coupled between the shafts and positioned between the base and the bridge, a first channel formed between the bridge and the body, the body including a plurality of second grooves, one of the second grooves cooperating with an associated one of the first grooves to form a second channel, the body forming an electrically conductive path between the first conductor positioned in the first channel and a second conductor positioned in the second channel;

a first insulation-piercing member positioned in the first channel for engaging the first conductor; and a plurality of second insulation-piercing members, each second insulation-piercing member positioned in an associated one of the second channels.

10. The connector of claim 9, wherein the body is movable relative to both the bridge and the base to modify a size of the first channel and a size of the second channel.

11. The connector of claim 9, wherein the bridge includes an arcuate portion positioned between the first end and the second end, each of the shafts being a bolt having a head and a threaded end, the bridge positioned adjacent the heads of the bolts.

12. The connector of claim 9, wherein the first insulation-piercing member includes a tooth protruding from a first end of the body proximate the first channel, and wherein each of the second insulation-piercing members includes a tooth protruding from a second side of the body opposite the first side.

13. The connector of claim 9, wherein the body includes a first body end slidably coupled to one of the shafts and a second body end slidably coupled to the other of the shafts, the first body end and the second body end being at least partially formed from an electrically-insulating material.

14. The connector of claim 9, wherein the base is formed of an electrically-insulating material.

15. The connector of claim 9, wherein each of the shafts is a bolt having a head and a threaded end, wherein the base is positioned adjacent the threaded ends of the shafts and secured by members threadably engaging the threaded ends.

16. A connector for electrically connecting a first conductor and a plurality of second conductors, the connector comprising:

a U-shaped member including a pair of substantially parallel legs and an intermediate portion connecting the legs;

a base coupled between the legs and positioned proximate ends of the legs, the base including a plurality of first grooves;

a body coupled between the legs and positioned between the base and the intermediate portion, a first channel formed between the intermediate portion and the body, the body including a plurality of second grooves, one of the second grooves cooperating with an associated one of the first grooves to form a second channel, the body forming an electrically conductive path between the first conductor positioned in the first channel and a second conductor positioned in the second channel;

a first insulation-piercing member positioned in the first channel for engaging the first conductor; and a plurality of second insulation-piercing members, each second insulation-piercing member positioned in an associated one of the second channels.

17. The connector of claim 16, wherein the body is movable relative to both the intermediate portion and the base to modify a size of the first channel and a size of the second channel.

18. The connector of claim 16, wherein ends of the legs are threaded, wherein the base is secured by members threadably engaging the ends of the legs, the base formed from an electrically-insulating material.

19. The connector of claim 16, wherein the first insulation-piercing member includes a tooth protruding from a first end of the body proximate the first channel, and wherein each of the second insulation-piercing members includes a tooth protruding from a second side of the body opposite the first side.

20. The connector of claim 16, wherein the body includes a first end slidably coupled to one of the legs and a second end slidably coupled to the other of the legs, the first end and the second end being at least partially formed from an electrically-insulating material.

* * * * *